US005515542A

United States Patent [19]

Simmons

[11] Patent Number: 5,515,542

[45] Date of Patent: May 14, 1996

[54] TATTOO-LIKE EFFECT APPAREL

[76] Inventor: Kimberly A. Simmons, 329 Lorimer St., Salinas, Calif. 93901

[21] Appl. No.: 410,974

[22] Filed: Mar. 27, 1995

[51] Int. Cl.[6] ..... A41D 5/00

[52] U.S. Cl. ..... 2/67; 2/69; 2/243.1

[58] Field of Search ..... 2/67, 69, 106, 2/115, 246, 1, 243.1; 428/918, 919, 15–18, 21, 24, 913

[56] References Cited

U.S. PATENT DOCUMENTS 3,683,419 8/1972 Lewis .
4,115,615 9/1978 de Buck van Overstraeten .
4,546,493 10/1985 Bortnick .
4,642,250 2/1987 Spector ..... 2/67
5,033,118 7/1991 Lincoln .
5,065,458 11/1991 Johnson ..... 2/69
5,435,010 7/1995 May ..... 2/67

*Primary Examiner*—C. D. Crowder
*Assistant Examiner*—Gloria Hale
*Attorney, Agent, or Firm*—LaRiviere, Grubman & Payne

[57] ABSTRACT

A garment made of a material which is opaque when dry and substantially translucent when wet for displaying, when in a wet state, tattoo-like effects of a second opaque material. The garment may include panels under or over an outer shell of the opaque/translucent material for providing tattoo-like designs.

17 Claims, 3 Drawing Sheets

TATTOO-LIKE EFFECT APPAREL

TECHNICAL FIELD

The present invention relates to apparel which allows a wearer to display one or more tattoo-like effects which appear in a wet state and do not appear as tatoo-like effects in a dry state.

BACKGROUND ART

A variety of different apparel have been introduced over the years. U.S. Pat. Nos. 4,115,615 and 4,546,493 describe fabric and apparel, respectively, which is substantially transparent to ultraviolet light wavelengths. Consequently, a wearer of such a fabric or apparel is able to tan or burn through their clothes. Contrarily, U.S. Pat. No. 5,033,118 issued to Lincoln, describes a sun-shielding ventilated shirt. Lincoln is directed at protecting one from the sun's harmful rays while providing cooling comfort through ventilation.

In U.S. Pat. No. 3,683,419 issued to Lewis, a garment formed by two attached panels is described. One of the panels is formed with two piles of flexible material. The outer of the piles is made of a transparent material and includes a pattern thereon. The inner of the piles is made of an opaque material and includes a pattern thereon. The two piles are positioned such that the two patterns overlap and move with respect to one another to create a moire visual effect.

DISCLOSURE OF INVENTION

The present invention is directed at providing a garment, which when wet, produces a tattoo-like effect. Thus, the present invention is directed at the swimsuit industry. However, other types of garments may be made incorporating the present invention. For example, the present invention may be used with pants, blouses, body suits, lingerie, active wear, or like apparel.

More specifically, the present invention is directed at combining two types of material. One type of material is substantially opaque when in a dry state and substantially transparent when in a wet state. The other type of material is substantially opaque when in a dry state and when in a wet state. In either state of the other type of material, the color of the material may be observed. Thus, when such a garment, according to the present invention, is worn in the dry state it will appear as a substantially opaque piece of clothing. The material which is opaque in both states, wet and dry, may be the underlayer or the overlayer (surface design). The clothing may appear to be monochromatic or polychromatic. However, when a garment according to the present invention is worn in a wet state, it will display tattoo-like effects, i.e., the opaque piece of clothing when in a wet state will form the tattoo-like effects while the transparent piece of clothing, owing to the wet state, will have "disappeared."

Other features of the present invention are disclosed or apparent in the section entitled: "BEST MODE FOR CARRYING OUT THE INVENTION."

BRIEF DESCRIPTION OF DRAWINGS

For fuller understanding of the present invention, reference is made to the accompanying drawing in the following detailed description of the Best Mode of Carrying Out the Invention. In the drawing.

Figure 1:
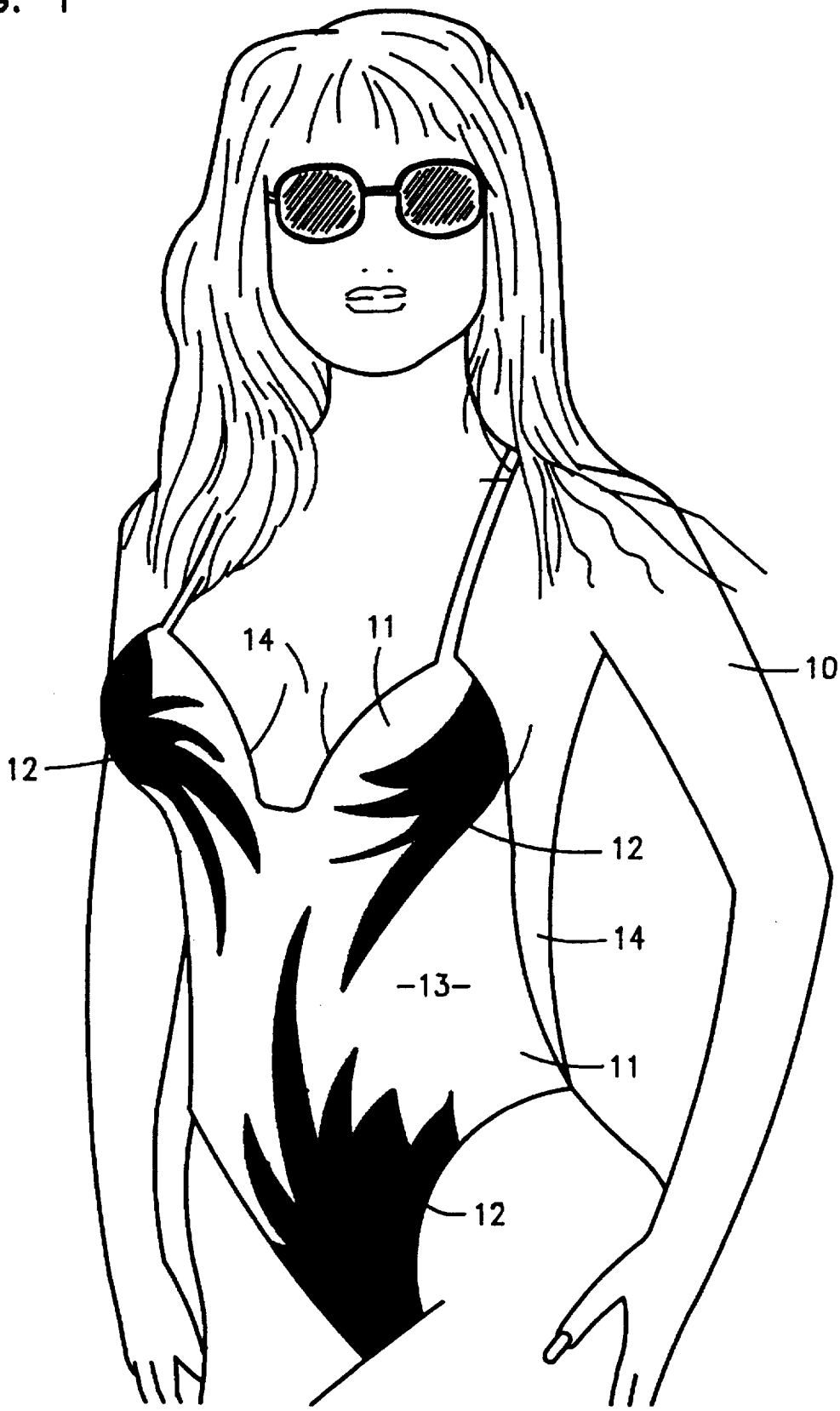
FIG. 1 is a perspective view of a garment in accordance with the present invention as worn by a wearer.

Reference numbers refer to the same or equivalent parts of the present invention throughout the several figures of the drawing.

BEST MODE FOR CARRYING OUT THE PRESENT INVENTION

Referring to FIG. 1, there is shown a perspective view of a garment 13, worn by wearer 10, in a dry state in accordance with the present invention. As shown, garment 13 is made of at least two types of materials, namely, opaque/translucent material 11 and opaque material 12. Material 11 is substantially opaque when in a dry state and substantially transparent when in a wet state, material 11 is a LYCRA, spandex type material which may be made of a blend of materials, such as lycra and nylon. Material 11 is preferably a blend of 78% nylon and 22% LYCRA, spandex. To enhance the disappearing illusion of material 11, it may be made as having a color for matching skin tone of skin 14 of wearer 10. Matching the skin tone of skin 14 of wearer 10 to the color of material 11 further facilitates the disappearing illusion. Additionally, to enhance the disappearing illusion it is important that air pockets created between garment 13 and skin 14 of wearer 10 be minimized. Thus, it is important that material 11 be suitably flexible for adhering to contours of wearer 10, and garment 13 may be tailored to conform to contours of wearer 10. In particular, in the case of a swimsuit, as shown in FIG. 1 for a female wearer 10, it may be necessary to have a low cut appearance to avoid air pockets between garment 13 and the cleavage of wearer 10. Material 12 is opaque when in either a wet or a dry state. Material 12 may be made of a material or a blend of materials. Material 12 may also be of a color and/or designed to be hidden or otherwise camouflaged by material 11. Preferably, material 12 is a material or blend of materials suitable for retaining water. A suitably stretchable material 12 is also preferable. Material 12 may be made out of a blend of LYCRA, spandex and cotton.

While the present invention is shown with respect to a female wearer 10 and a swimsuit garment 13, it should be understood that other types of wearers and other types of garments may be employed in accordance with the present invention.

Figure 2:
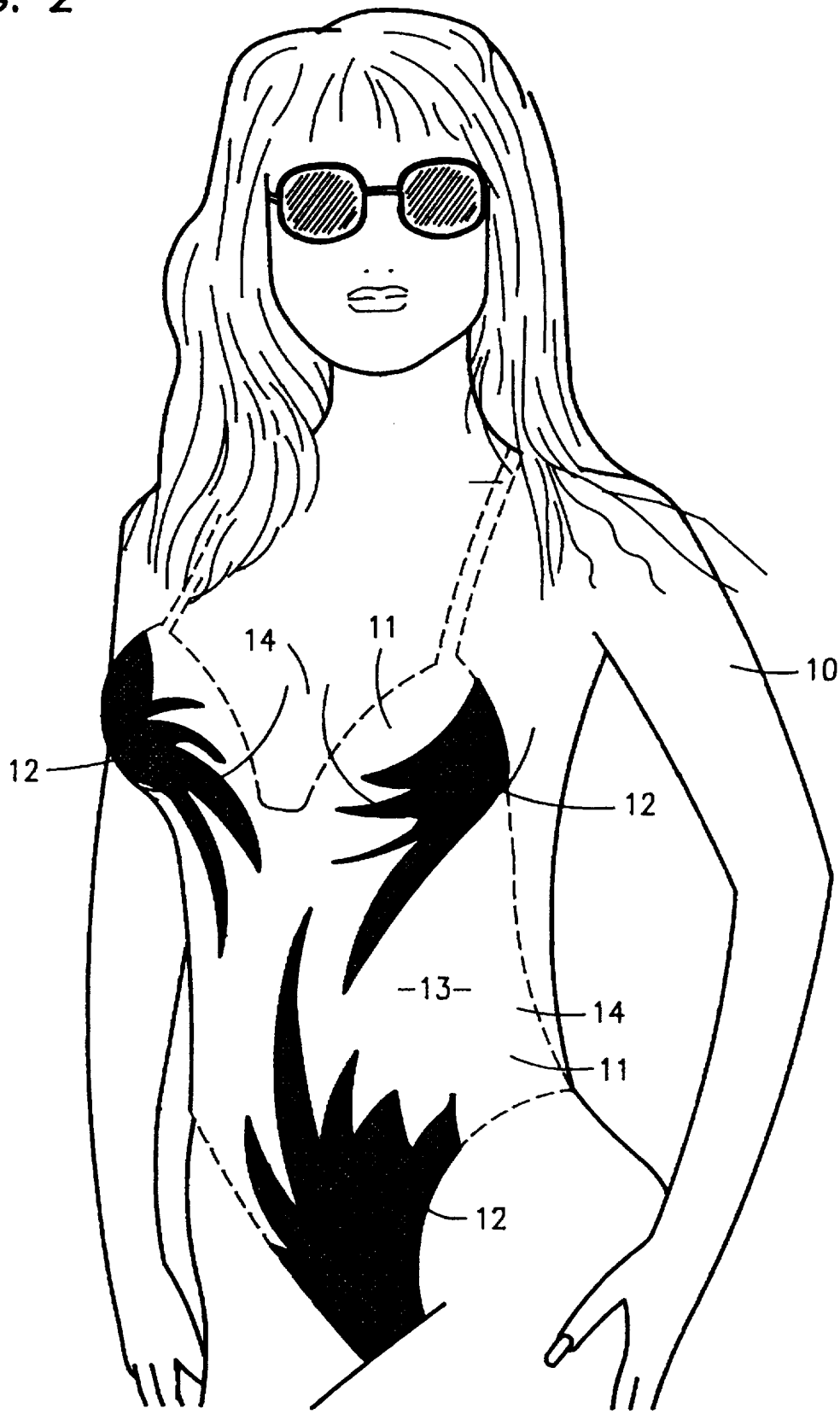
FIG. 2 is a perspective view of the garment of FIG. 1 in a wet state in accordance with the present invention.

Referring now to FIG. 2, there is shown a perspective view of garment 13, worn by wearer 10, in a wet state in accordance with the present invention. Dashed lines indicate that material 11 of garment 13 is now translucent. Material 12 remains opaque when garment 13 is in a wet state. Thus, material 12 appears as body tattoo-like effects. While three body tattoo-like effects are shown, it should be understood that fewer or more body tattoo-like effects may be employed in accordance with the present invention.

When a garment 13 is sufficiently dry, it again will appear opaque as shown in FIG. 1.

Material 12 may be made in the form of a single panel. The panel may be attached to material 11 to form garment 13 by connecting seams at certain edges of the panel to collectively form a desired design shape.

Figure 3:
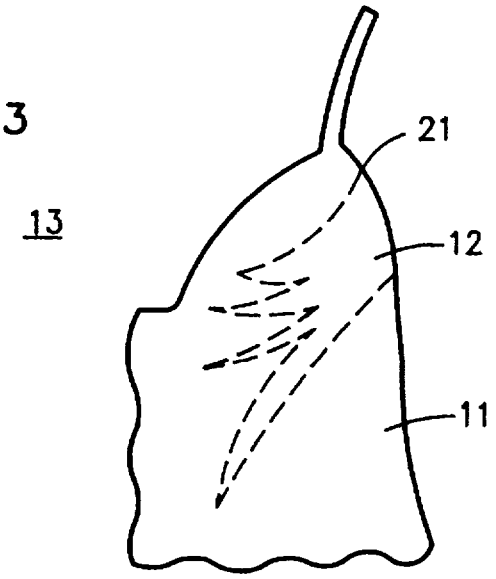
FIG. 3 is a top plan view of a broken away portion of the garment of FIG. 1.

Referring now to FIG. 3, there is shown a top plan view of a broken away portion of garment 13. Material 12 is attached underneath, as indicated by dashed line 21, an outer covering of material 11. This is to be contrasted with material 12 appearing on the outer side of garment 13 as shown in FIG. 1. Therefore, it should be understood that material 12 may be attached either under or over material 11.

With continuing reference to FIG. 3 in combination with FIG. 2, by attaching material 12 on the underside of garment 13, such that material 11 covers material 12, material 12 is less perceptible. Thus, it is possible to conceal one or more body tattoo-like designs. Moreover, garment 13 may include one or more body tattoo-like designs incorporated into patterns in material 11 in order to camouflage resulting body tattoo-like effects when in a wet state. Moreover, having material 12 next to skin 14 of wearer 10 facilitates trapping of water between skin 14 and material 12 to enhance and maintain the body tattoo-like effect.

Figure 4:
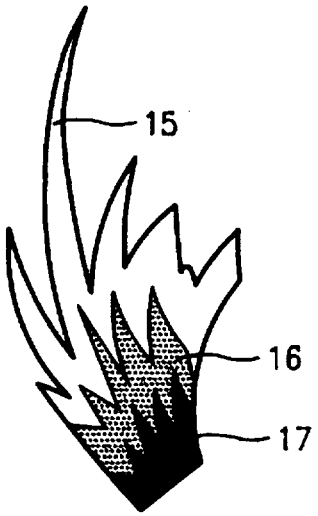
FIG. 4 is a top plan view exemplifying a plurality of plies forming a panel in accordance with the present invention.

Referring to FIG. 4, there is shown a top plan view of a panel 22 made of a plurality of piles 15, 16, 17 tier garment 13 shown in FIGS. 1 and 2. By having a plurality of plies 15, 16, 17, it is possible to selectively overlap elements of each of the plies. In this manner, the thickness of panel 22 will vary from one location to another. Thus, ply 15 will be thinner than the combination of plies 15 and 16, which will be thinner than the combination of plies 15, 16 and 17. In the flame-like pattern as shown in FIG. 4, single ply 15 will dry more readily than plies 15 and 16 in combination. Furthermore, plies 15 and 16 in combination will dry more readily than plies 15, 16 and 17 in combination. Thus, in the flame design of panel 22, it will appear as though the flame dies down as material 11 shown in FIG. 3 covering panel 22 goes from a wet state to a one or more semi-dry states, and then to a dry state.

Figure 5:
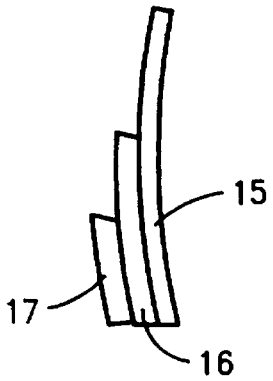
FIG. 5 is a side plan view of the panel of FIG. 4.

In FIG. 5, there is shown a side plan view of panel 22 exaggeratedly illustrating the overlapping of plies 15, 16, and 17. While three plies are shown, it should be appreciated that panel 22 may be formed of one or more plies.

The present invention is not limited to the designs disclosed herein, but may incorporate other designs. Moreover, it should be understood that the second material may be any type of opaque material when in either a wet or dry state. Material 12 may be glitter, sequins, paint, ink, shells, beads, dye, metallic particles, thread, yarn, fabric, or the like. Moreover, material 12 may be attached to material 11 for forming garment 13 by painting, inking, sewing, gluing, weaving, fusing, printing, dying, stringing, or the like.

Again, though what has been described with reference to FIG. 3 is material 12 under material 11, it is also possible to apply material 12 to the surface of material 11, optionally along with any accessories. In which case, material 12 will be visible before and after being wet, and material 11 will act as described elsewhere herein by becoming translucent when wet, the same as if material 12 were applied on the underside of material 11.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. The inventions illustratively disclosed herein may be practiced without any element which is not specifically disclosed herein.

I claim:

1. A garment comprising:

a first material, the first material being substantially opaque when in a dry state and being of a suitable color such that it is substantially transparent when in a wet state;

a second material, the second material being substantially opaque when in a wet state and when in a dry state; and application means for attaching the first material and the second material together, the first material and the second material in combination forming the garment;

the second material appearing as a tattoo-like form on a wearer's body when the garment is in the wet state as the first material is then substantially transparent, the garment appearing as substantially opaque clothing when in the dry state.

2. The garment of claim 1 wherein the first material is made of a spandex material.

3. The garment of claim 1 wherein the first material is made of a blend of materials comprising spandex and nylon.

4. The garment of claim 1 wherein the first material is flexible for reducing air pockets.

5. The garment of claim 4 wherein the first material is of a desired color for matching skin tone.

6. The garment of claim 4 wherein the second material is a blend of fabrics, one of the fabrics suitable for retaining water for an extended period of time.

7. The garment of claim 6 wherein the second material is made in a form of at least one panel for attachment to the first material.

8. The garment of claim 7 wherein the panel is attached to the first material such that the panel is closer to the wearer's skin.

9. The garment of claim 8 wherein the first material forms an outer shell of the garment, the second material being located under the first material.

10. The garment of claim 9 wherein the first material obscures the second material such that the garment has a substantially monochrome appearance.

11. The garment of claim 1 wherein the second material is made of a plurality of plies of one or more fabrics.

12. The garment of claim 11 wherein the plies do not completely overlap with respect to one another such that the tattoo-like form changes as the second material goes from the wet state to the dry state.

13. The garment of claim 1 wherein the second material is selected from the group consisting of glitter, sequins, paint, ink, shells, beads, dye, metallic particles, thread, yarn and fabric.

14. The garment of claim 1 wherein the application means is selected from the group consisting of painting, inking, sewing, gluing, weaving, fusing, dyeing and stringing.

15. The garment of claim 1 wherein the second material is made of spandex and cotton blend.

16. The garment of claim 1 wherein the second material is applied to an outer surface of the first material.

17. The garment of claim 1 wherein the second material comprises at least one color for providing a tattoo-like effect when the first material is in the wet state.

* * * * *